US007621694B1

(12) United States Patent
Goodman et al.

(10) Patent No.: US 7,621,694 B1
(45) Date of Patent: Nov. 24, 2009

(54) CURB AND GUTTER FORMING METHOD

(75) Inventors: Michael J. Goodman, Sabetha, KS (US); John A. Armstrong, Fairview, KS (US)

(73) Assignee: Curb Roller LLC, Sabetha, KS (US)

( * ) Notice: Subject to any disclaimer, the term of this patent is extended or adjusted under 35 U.S.C. 154(b) by 0 days.

(21) Appl. No.: 12/171,084

(22) Filed: Jul. 10, 2008

(51) Int. Cl.
*E01C 19/24* (2006.01)

(52) U.S. Cl. ..... 404/98; 404/119; 404/124; 404/127; 404/128; 404/131; 404/132

(58) Field of Classification Search ..... 404/96, 404/97, 98, 119, 122, 124, 127, 128, 131, 404/132
See application file for complete search history.

(56) References Cited

U.S. PATENT DOCUMENTS

| | | | | | |
|---|---|---|---|---|---|
| 827,587 | A | * | 7/1906 | Warner | 172/538 |
| 1,018,780 | A | | 2/1912 | Rauschenbach | |
| 2,831,408 | A | | 4/1958 | Konway | |
| 2,962,948 | A | | 12/1960 | Tout et al. | |
| 3,532,032 | A | * | 10/1970 | Weber et al. | 404/87 |
| 3,705,638 | A | | 12/1972 | Shock | |
| 3,796,505 | A | * | 3/1974 | Buhler | 404/132 |
| 4,131,162 | A | * | 12/1978 | Schmitz | 172/138 |
| 4,142,815 | A | * | 3/1979 | Mitchell | 404/103 |
| 4,169,305 | A | * | 10/1979 | Kruszona | 29/235 |
| 4,208,151 | A | | 6/1980 | Cross | |
| 4,438,819 | A | * | 3/1984 | Ryals | 172/536 |
| 4,702,640 | A | | 10/1987 | Allen | |
| 5,018,955 | A | | 5/1991 | Parrish et al. | |
| 5,062,737 | A | | 11/1991 | Samuels | |
| 5,468,095 | A | * | 11/1995 | Dawson | 404/118 |
| 5,527,129 | A | | 6/1996 | McKinnon | |
| 6,049,970 | A | * | 4/2000 | Reis et al. | 29/798 |
| 6,302,620 | B1 | | 10/2001 | Mutsuji et al. | |
| D459,175 | S | * | 6/2002 | Monteil | D8/45 |
| 6,402,425 | B1 | | 6/2002 | Paladeni | |
| 6,502,313 | B1 | * | 1/2003 | Bilodeau | 30/292 |
| 6,863,470 | B2 | | 3/2005 | Eggleton et al. | |
| 6,941,632 | B1 | * | 9/2005 | Mead et al. | 29/424 |
| D512,568 | S | * | 12/2005 | Cho | D4/122 |

* cited by examiner

*Primary Examiner*—Gary S Hartmann
(74) *Attorney, Agent, or Firm*—Hovey Williams LLP

(57) ABSTRACT

A curb forming machine for use by a single operator to form curved curbing includes a single rotatable curb-forming roller, a handle assembly for pulling and maneuvering the roller, and a motor for rotating the roller. The roller includes a generally cylindrical body, a neck at one end of the body, and a shaping surface, all of which are coaxial. The motor rotates the roller so that the lower periphery of the roller moves toward the direction of pulling to shape and smooth wet concrete into curbing. An overflow guard prevents wet concrete from flowing over the roller onto the finished curb, and an alignment device extends outwardly from the roller to contact a form member. A curb forming method includes pulling and steering such a roller around a curved form, including around tight curves in the form.

10 Claims, 8 Drawing Sheets

CURB AND GUTTER FORMING METHOD

TECHNICAL FIELD

The present invention relates generally to a power tool and method for forming wet concrete into finished curb and gutter. More particularly, the present invention concerns a power tool that permits a single operator to form wet concrete into longitudinally curved curbing within a form including a pair of laterally spaced, longitudinally extending, curved form members, where one of the form members is shorter than the other.

BACKGROUND

The use of curb and gutter to line the lateral sides of roads, parking lots, and the like is generally known in the art. Such curb and gutter is typically formed of concrete and serves to provide proper drainage of the roadway and enhance safety by keeping motorists from driving onto the shoulder, median, or sidewalk. The curbing can be laid either before or after the formation of the roadway or other intermediate surface. Commonly, the curbing is laid first and then the pavement is put down between the curbs. This is particularly the order used for new construction projects. Laying the curbing when the roadway or other surface is already in place is often done as part of a tear out or repair project, and is typically done by hand.

As is the case with many concrete forming projects, a form is typically used to define the path of the curbing to be laid. Such a form can be made of wooden supports, metal, or other suitable material during the construction of new curbing. Alternatively, the form can be made of the existing roadway and sidewalk during the construction for a repair job. Wet concrete is placed within the form, in between laterally spaced form members, and is then shaped and smoothed to form the finished curbing.

Conventionally, curbing has been formed in one of two ways—either a large, dedicated machine is used, or the curbing is formed by hand. For large jobs with straight curbing and considerable length, a slip form paver is used to travel along the form to shape and smooth the concrete into curbing. The slip form machine is satisfactory in many respects, but it also presents numerous challenges. For example, such a slip form machine is very large and expensive, and it can only be used to lay curbing along substantially straight paths. The size of the machine makes it unable to turn sharp curves. This shortcoming makes the slip form machine unsuitable for paths requiring a lot of tight curves or other small jobs.

Traditionally, curves in the curbing have been formed by hand, requiring a considerable crew of skilled laborers to form the wet concrete into shaped and smooth curb and gutter. This has historically been time-consuming and back-breaking work that is often difficult and expensive for which to provide manpower. The hand shaping by skilled laborers is not only difficult work, but it also tends to lead to imperfections in the final result, such as wavy curbs. Such hand shaping is often used both for the areas where a slip form machine cannot be used, and for the entirety of small jobs, proving to be a significant obstacle for many contractors.

SUMMARY

The present invention provides a power tool and method for permitting a single operator to easily form wet concrete into straight or longitudinally curved curbing. In forming curved curbing, the wet concrete is placed within a form including a pair of laterally spaced, longitudinally extending, curved form members, with one of the form members being shorter than the other. The tool includes a concrete forming device consisting of a single rotatable curb-forming roller, a handle assembly that is operably coupled to the concrete forming device, and a motor that is operably coupled to the concrete forming device. The motor serves to drive the roller in a direction of rotation generally opposite of the direction of advancement of the tool. This rotational movement causes the concrete to be "screeded" and smoothed into the final shape of the finished curb, as dictated by the shape of the curb-forming roller. After passing over the wet concrete with the tool, the concrete can be lightly touched up using trowels if necessary.

The power tool and method of the present invention can be used by a single operator to easily form concrete curbing of a consistent shape, and is particularly useful in forming curbing around curves, including tight curves having a small radius of curvature (such as parking lot islands and the like), as well as straight sections. Such use of a power tool by a single operator can minimize the required crew size for forming operations and drastically reduce the need for expensive and hard-to-find skilled manual labor in creating curved curbing, particularly for tight radius curves. The power tool is small and compact, making it easy to transport to and from a jobsite, and can be used by unskilled laborers with very little training. In addition to new construction projects with concrete disposed between dedicated form members, the tool and method can also be used for tear out and repair jobs, using existing structure for the form members, eliminating any need to tear up pavement to repair curbs and virtually eliminating hand shaping.

This summary is provided to introduce a selection of concepts in a simplified form that are further described below in the detailed description of the preferred embodiments. This summary is not intended to identify key features or essential features of the claimed subject matter, nor is it intended to be used to limit the scope of the claimed subject matter.

Various other aspects and advantages of the present invention will be apparent from the following detailed description of the preferred embodiments and the accompanying drawing figures.

BRIEF DESCRIPTION OF THE DRAWINGS

A preferred embodiment of the present invention is described in detail below with reference to the attached drawing figures, wherein.

Figure 1:
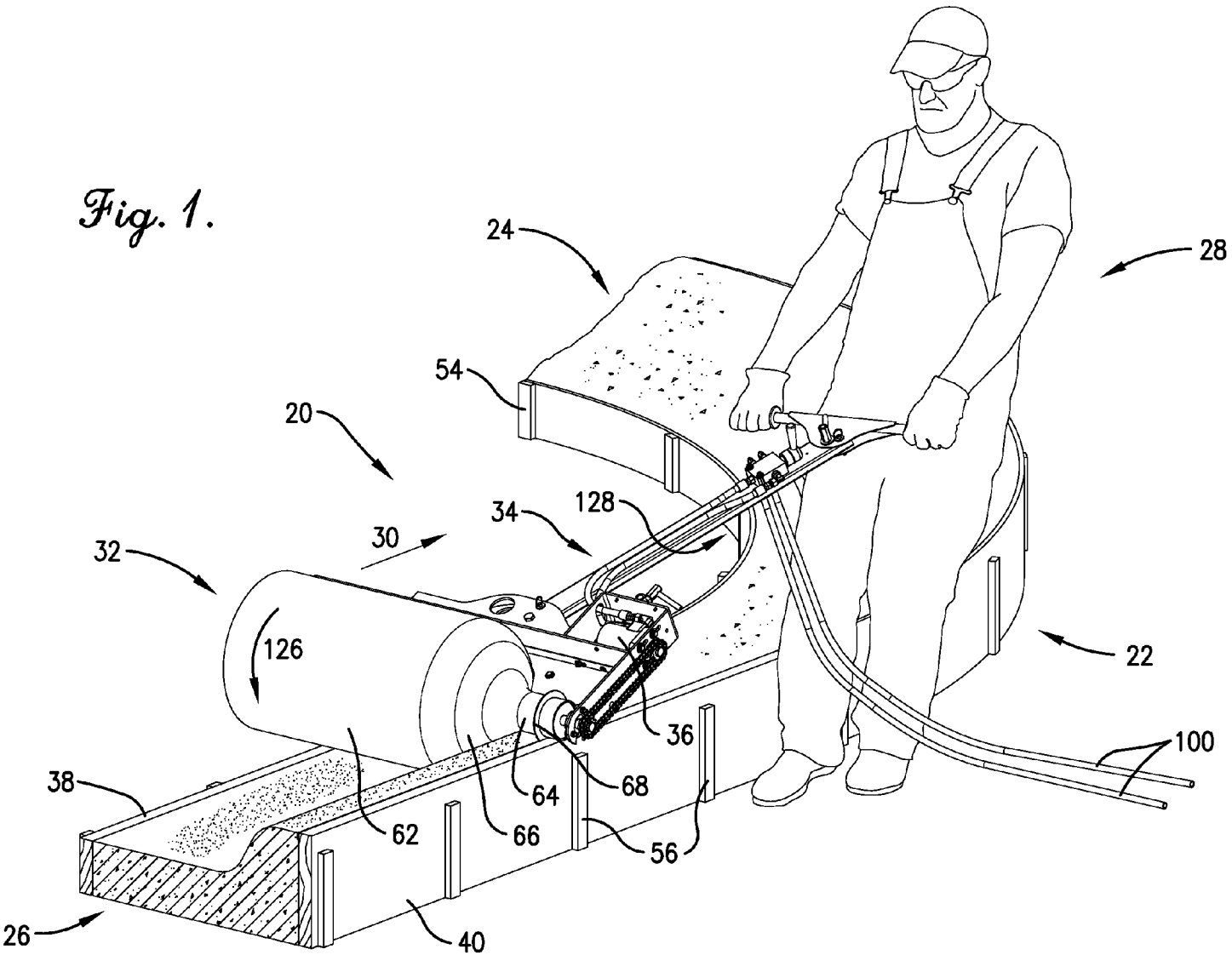
FIG. 1 is a perspective view of a curb forming tool constructed in accordance with the principles of the present invention, with the tool depicted in use being pulled along curved form members by a single operator to form longitudinally curved curbing.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION

The present invention is susceptible of embodiment in many different forms. While the drawings illustrate, and the specification describes, certain preferred embodiments of the invention, it is to be understood that such disclosure is by way of example only. There is no intent to limit the principles of the present invention to the particular disclosed embodiments.

With initial reference to FIG. 1, a power tool 20 selected for purposes of illustration is depicted on a longitudinally curved form 22 for forming wet concrete 24 into finished curbing 26. Power tool 20 is shown being pulled by a single operator 28 in a direction of advancement 30 to shape and smooth wet concrete 24 into finished curbing 26. Power tool 20 broadly includes a concrete forming device 32, a handle assembly 34, and a motor 36, as will be described in more detail below.

While power tool 20 is illustrated and described with particular reference to use with longitudinally curved form 22 to form curved finished curbing 26, such use along curves is not necessarily required. It is clear that power tool 20 can also be used to form straight sections of curbing (not shown in detail), as will be readily understood by one of ordinary skill in the art upon review of this disclosure.

Curved form 22 includes a short form member 38 and a tall form member 40. Short form member 38 has an inboard side 42 adjacent wet concrete 24, an outboard side 44 opposite inboard side 42, and a top surface 46. Similarly, tall form member 40 has an inboard side 48 adjacent wet concrete 24, an outboard side 50 opposite inboard side 48, and a top surface 52. As will be readily appreciated by one of ordinary skill in the art, a plurality of short form supports 54 are disposed adjacent outboard side 44 of short form member 38 and a plurality of tall form supports 56 are disposed adjacent outboard side 50 of tall form member 40 to prevent pressure within wet concrete 24 or finished curbing 26 from moving form 22 out of position.

Depicted form 22 is representative of concrete forming during new construction. As will be readily appreciated by one of ordinary skill in the art, however, spacing between form members 38 and 40 can be varied depending on the application, or an alternative form could exist between an existing roadway and an existing sidewalk, such as during a tear out or repair project. Use of power tool 20 with such spacing variation or an alternative form is clearly within the ambit of the present invention.

Figure 2:
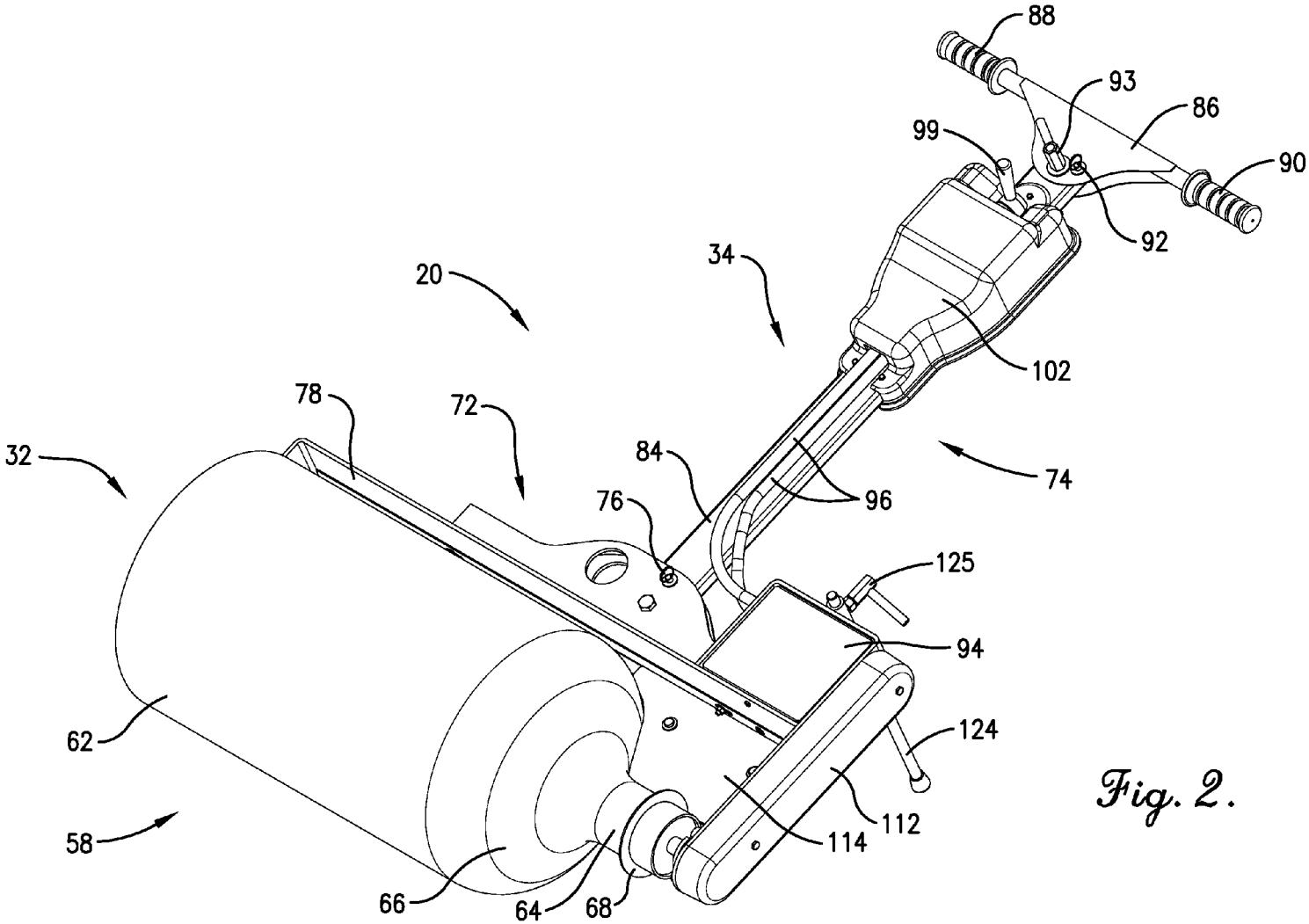
FIG. 2 is a perspective view of the curb forming tool shown in FIG. 1, broadly including a curb-forming roller, a handle assembly, and a motor, and illustrated with safety covers over various components and with the tool being supported by a removable stand.
Figure 3:
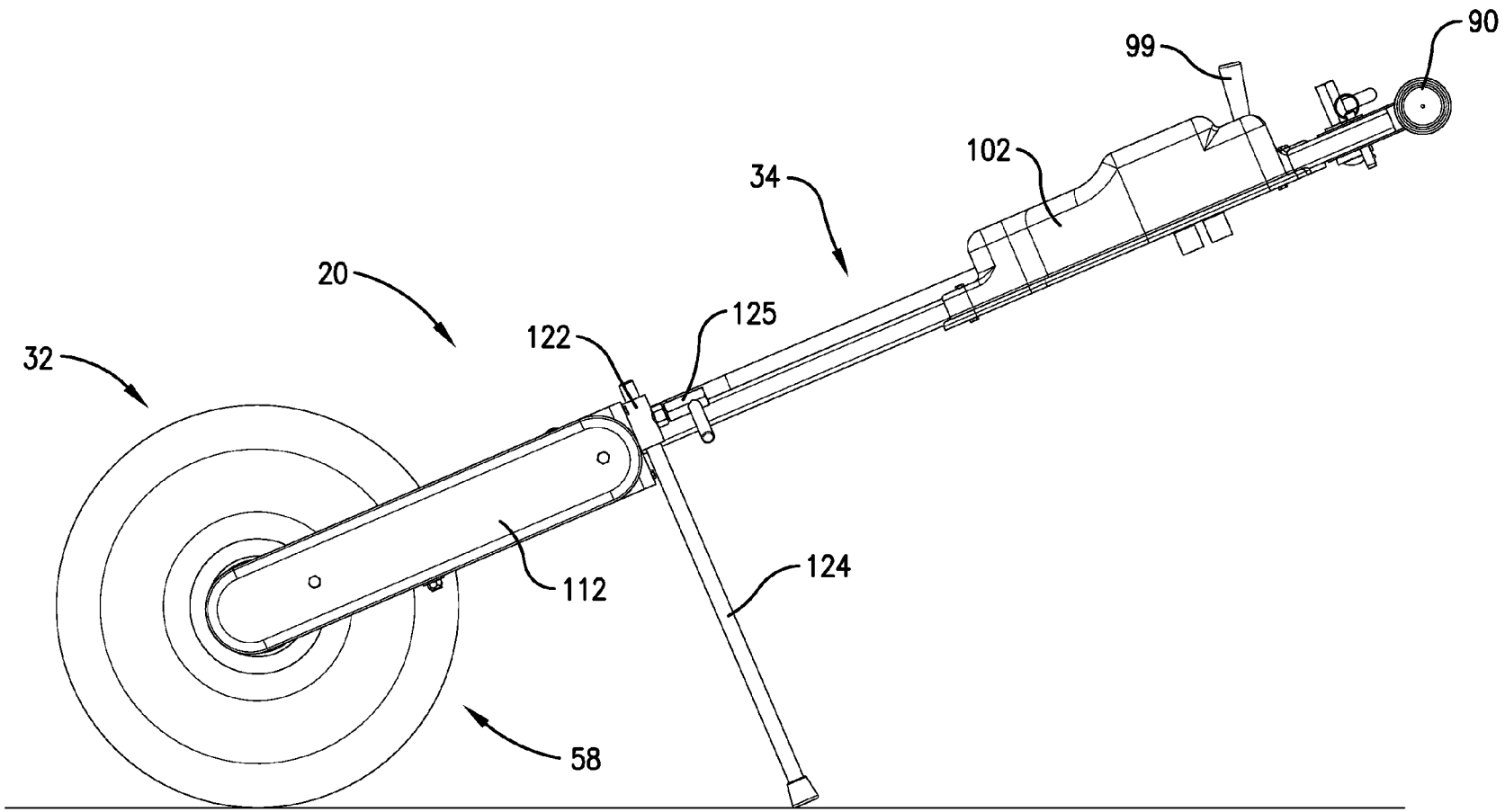
FIG. 3 is a side elevational view of the curb forming tool shown in FIG. 2.
Figure 4:
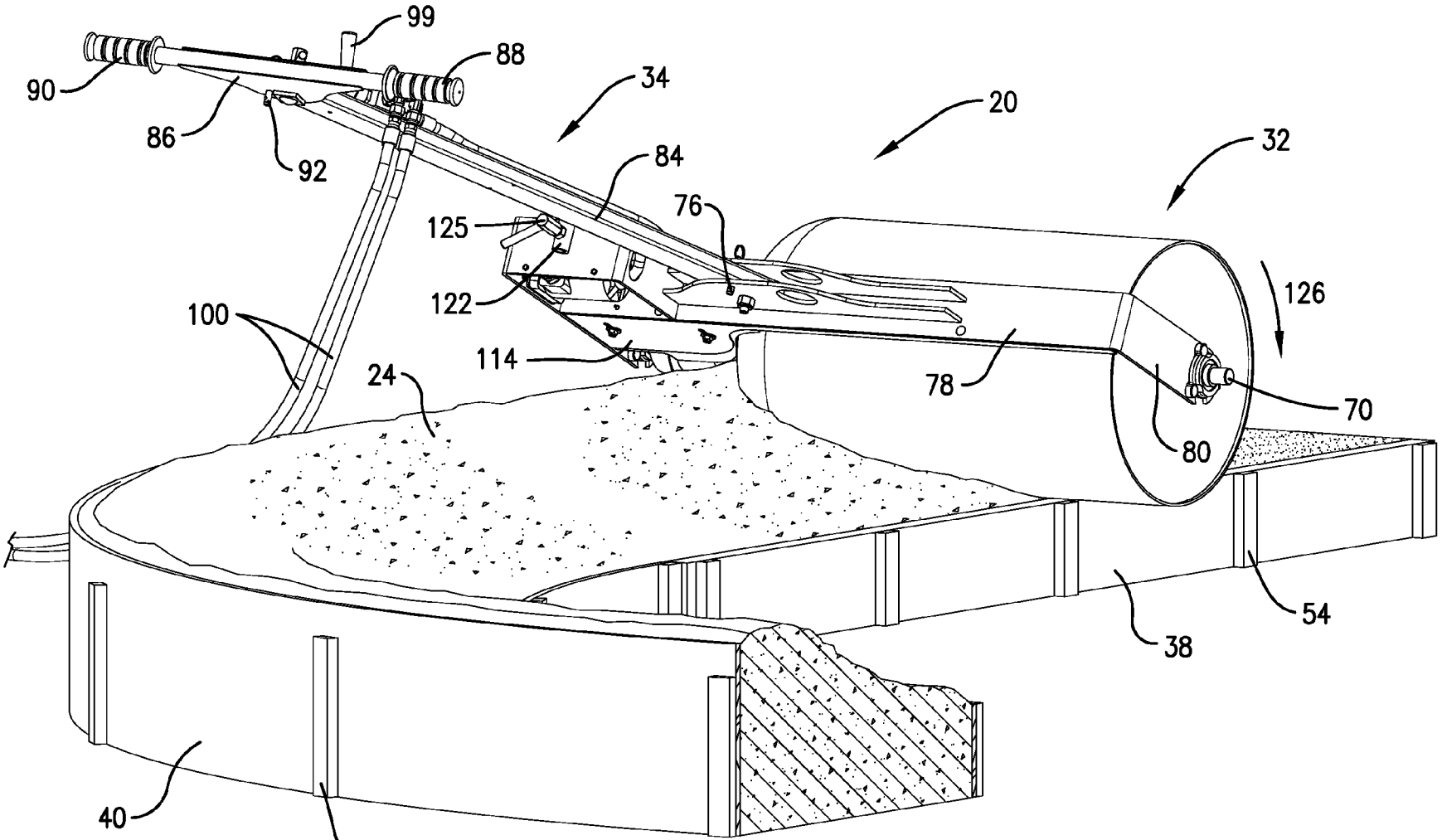
FIG. 4 is a perspective view of the curb forming tool depicted in FIG. 1, illustrated without the operator, and presented from the opposite operational vantage point, depicting in detail the curb-forming roller contacting wet concrete to form curved curbing.

With continued reference to FIG. 1, and turning also to FIG. 2, additional details of depicted power tool 20 will now be explained. Concrete forming device 32 consists essentially of a single rotatable curb-forming roller 58 that is rotatable about an axis of rotation 60. Curb-forming roller 58 is comprised of a generally cylindrical body 62, a reduced diameter neck 64, and a shaping surface 66. Shaping surface 66 extends smoothly between body 62 and neck 64. Curb-forming roller 58 is configured to ride on top of form 22. In particular, as shown in FIGS. 1 and 4, the outer periphery of cylindrical body 62 rides on top surface 46 of short form member 38, and the outer periphery of neck 64 rides on top surface 52 of tall form member 40.

In the illustrated embodiment, cylindrical body 62 presents a diameter of sixteen inches and neck 64 presents a diameter of four inches, such that power tool 20 forms finished curbing 26 that has a height of six inches. These dimensions are presented by way of example only, as one of ordinary skill in the art will readily appreciated that such dimensions could be altered in order to form curbing of different sizes. It will also be readily appreciated, that shaping surface 66 could also take alternative configurations to form curbing of different shapes without departing from the teachings of the present invention.

An alignment device in the form of a ring 68 extends radially outwardly from neck 64 of curb-forming roller 58. Ring 68 is configured for disposition laterally adjacent inboard face 48 of tall form member 40. As will be readily appreciated by one of ordinary skill in the art, disposition of ring 68 against inboard face 48 maintains power tool 20 in proper alignment with respect to curved form 22. Alternative alignment devices, such as an extension designed for disposition against outboard face 50 of tall form member 40 or against short form member 38, whether protruding from curb-forming roller 58 or handle assembly 34, are clearly within the ambit of the present invention.

Figure 7:
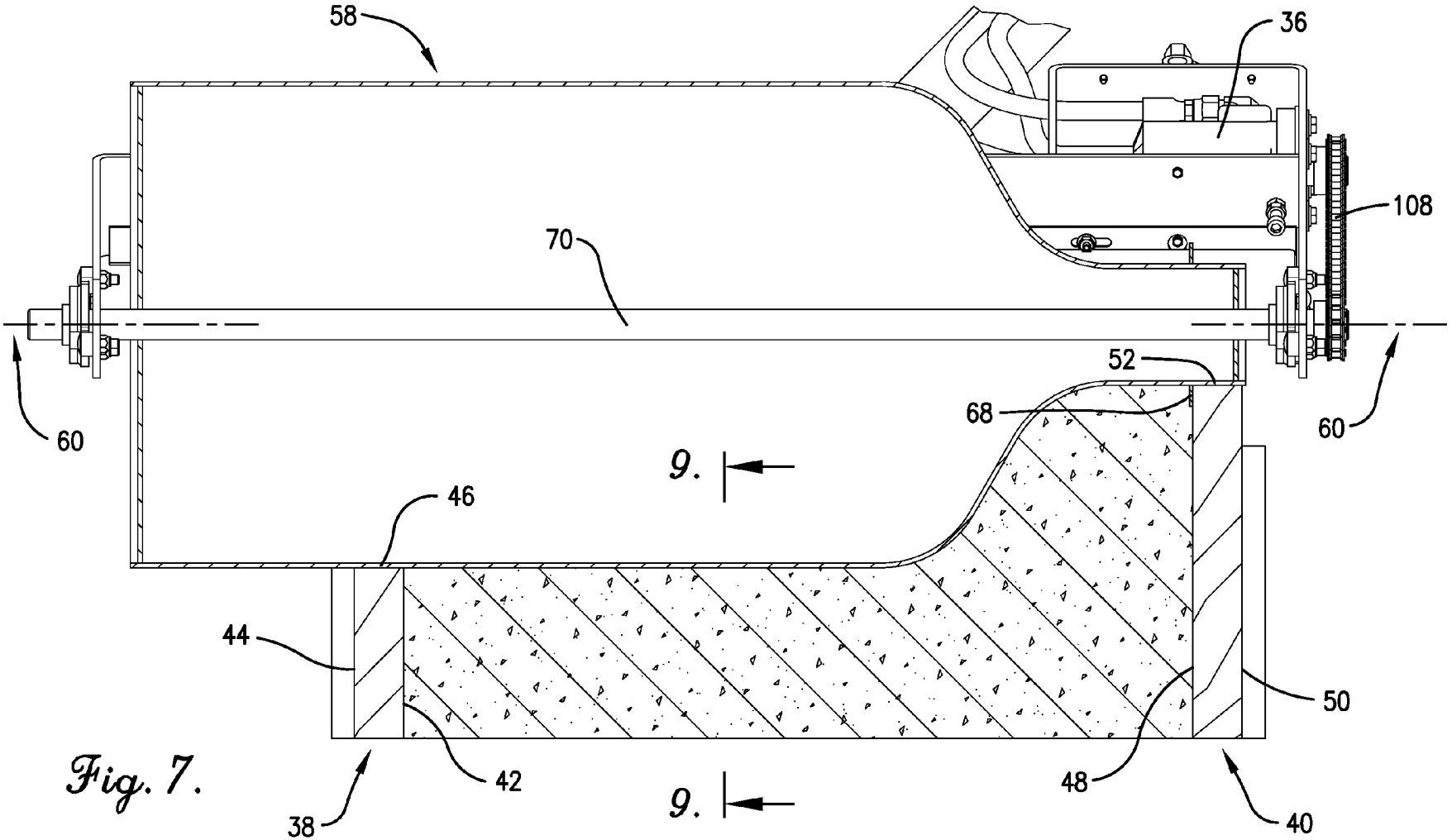
FIG. 7 is a partial sectional, side elevational view of the curb forming tool taken along the line 7-7 of FIG. 6, depicting in detail the curb-forming roller supported on the form members and in contact with wet concrete between the form members.

With attention now to FIG. 7, a shaft 70 is disposed along axis of rotation 60 and protrudes axially from opposite ends of curb-forming roller 58. In the depicted embodiment, the entire curb forming roller 58, including cylindrical body 62, neck 64, and shaping surface 66, is integrally formed as a single piece. Such construction, however, is by way of example only. Shaft 70 is journaled to handle assembly 34, which is operably coupled with curb-forming roller 58 along axis of rotation 60.

Figure 5:
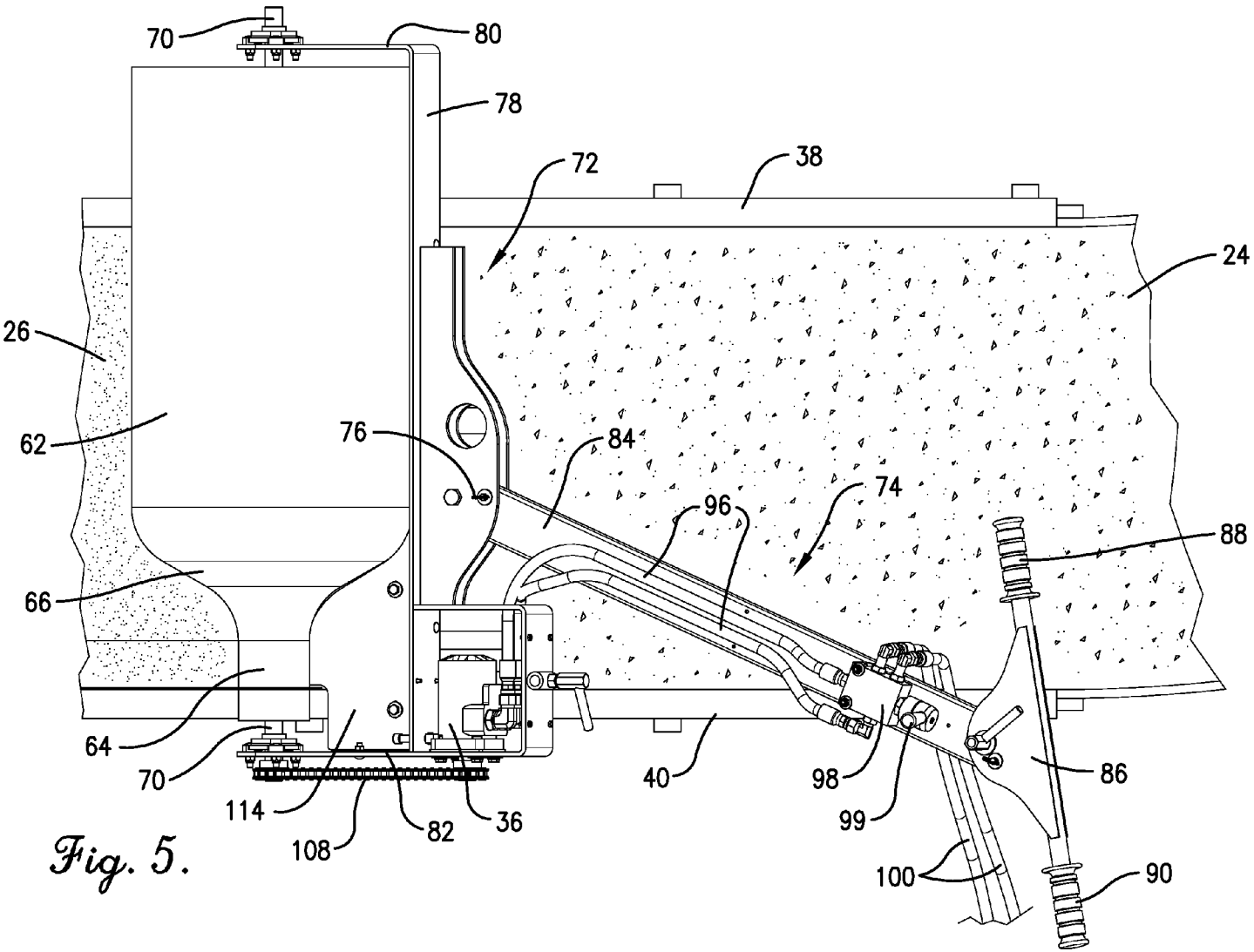
FIG. 5 is a top plan view of the curb forming tool shown in FIG. 4, depicting in detail the curb-forming roller, the adjustable handle assembly, and a portion of the form members.

Returning now to FIG. 2, and with attention also to FIGS. 4 and 5, handle assembly 34 broadly includes a yoke element 72 and a pull arm 74, with pull arm 74 being laterally positionable relative to yoke element 72 about a pin connection 76. Pin connection 76 further permits pull arm 74 to lock into various positions, such as straight back (as shown in FIG. 2) or offset such that operator 28 can pull power tool 20 from a position outboard of form 22 (as shown in FIG. 1). Yoke element 72 broadly includes a generally laterally extending frame number 78 and generally longitudinally extending arms 80 and 82. As shown best in FIG. 7, shaft 70 is journaled to handle assembly 34 at ends of arms 80 and 82.

Pull arm 74 includes an extension element 84, which extends generally longitudinally away from yoke element 72, and an operator handle 86, which includes a pair of laterally opposed hand grips 88 and 90. Operator handle 86 is laterally positionable relative to extension element 84 about a pin connection 92. Pin connection 92 further permits operator handle 86 to lock into various positions relative to extension element 84 for the convenience of operator 28. A handle tension adjuster 93 extends through both operator handle 86 and extension element 84 to facilitate snugly clamping operator handle 86 relative to extension element 84, as will be readily appreciated by one of ordinary skill in the art upon review of this disclosure.

Motor 36 is operably coupled with yoke element 72, as shown in FIGS. 1 and 5. As shown in FIG. 2, a motor cover 94 can be used to cover motor 36 for protection from the elements and for safety. Motor cover 94 is mounted to power tool 20 by a bolt-and-nut assembly (not shown) or other appropriate fastener, as will be readily appreciated by one of ordinary skill in the art upon review of this disclosure. In the illustrated embodiment, motor 36 is a hydraulic motor, although one of ordinary skill in the art will readily appreciate that an alternative motor, such as an electric motor, could be used without departing from the teachings of the present invention. Motor 36 is connected to hydraulic flow lines 96 that extend from motor 36 and run along at least a portion of extension element 84.

A hydraulic flow control valve 98 is disposed on extension element 84 near operator handle 86 and is configured to control the flow of hydraulic fluid through motor 36 to adjust the rotational speed of motor 36. A speed control knob 99 extends from hydraulic flow control valve 98 to facilitate adjustment of the rotational speed of motor 36 by operator 28, as will be readily appreciated by one of ordinary skill in the art upon review of this disclosure. Hydraulic supply lines 100 extend from hydraulic flow control valve 98 and are connected to a supply of pressurized hydraulic fluid (not shown), such as an excavator, skid loader, or other common equipment on a jobsite. As shown in FIG. 2, a control valve cover 102 can be used to cover hydraulic flow control valve 98 for protection from the elements and for safety. Control valve cover 102 is mounted to power tool 20 by a bolt-and-nut assembly (not shown) or other appropriate fastener, as will be readily appreciated by one of ordinary skill in the art upon review of this disclosure.

Figure 6:
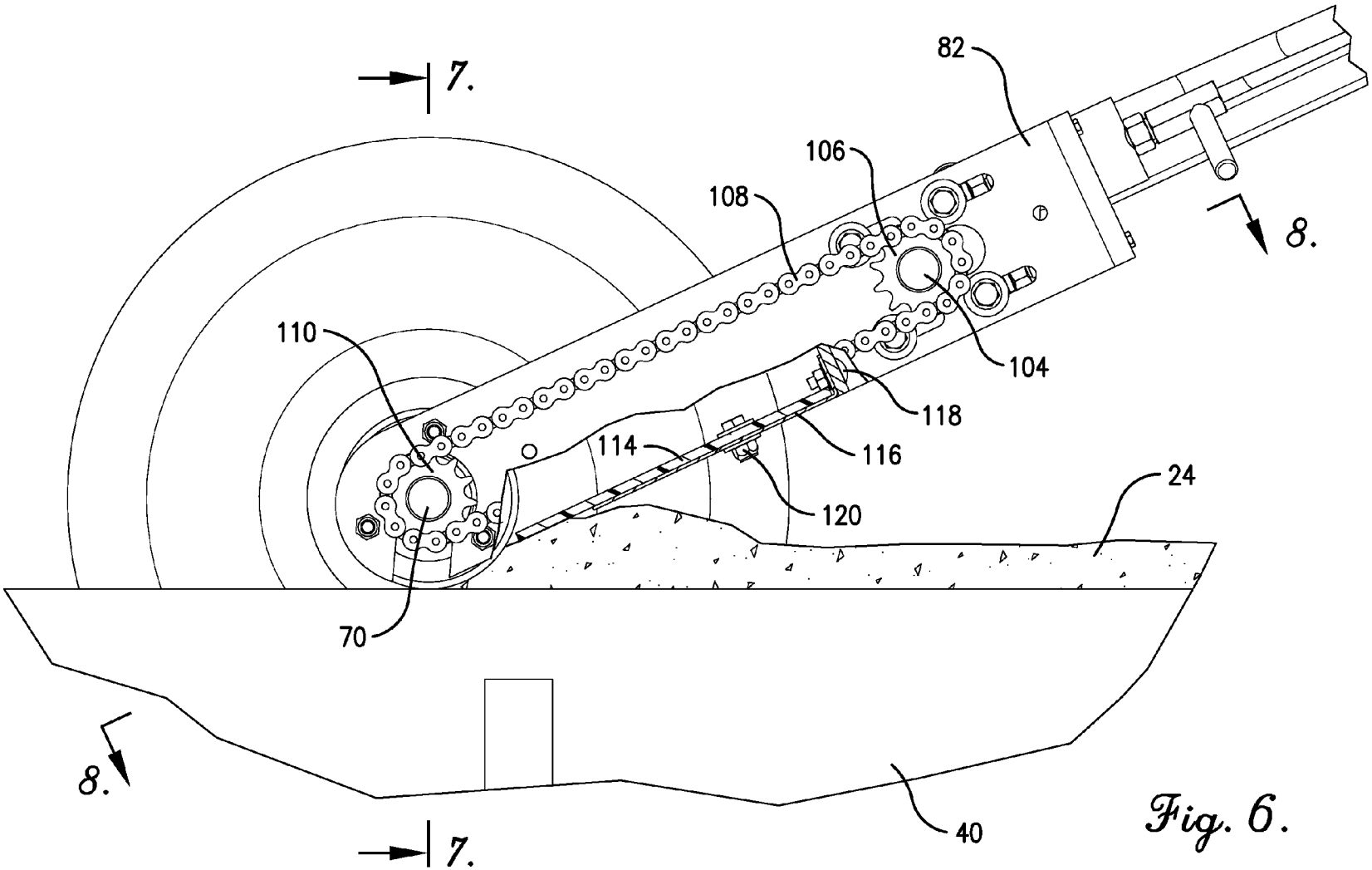
FIG. 6 is an enlarged, fragmentary, side elevational view of the curb forming tool shown in FIG. 4, similar in many respects to a part of the tool as shown in FIG. 3, but depicted with the safety covers removed to illustrate in detail a drive mechanism for driving the curb-forming roller.

With reference now to FIG. 6, motor 36 includes an output shaft 104 that turns a driving sprocket 106 that is rotationally fixed relative to output shaft 104. Rotation of driving sprocket 106 is transmitted by a chain 108 to a driven sprocket 110 that is rotationally fixed relative to shaft 70 of curb-forming roller 58. In this way, motor 36 powers the rotation of curb-forming roller 58 when hydraulic fluid flows through motor 36, as controlled by hydraulic flow control valve 98. As shown in FIG. 2, a chain cover 112 can be used to cover chain 108 and sprockets 106 and 110 for protection from the elements and for safety. Chain cover 112 is mounted to power tool 20 by a bolt-and-nut assembly (not shown) or other appropriate fastener, as will be readily appreciated by one of ordinary skill in the art upon review of this disclosure.

Figure 8:
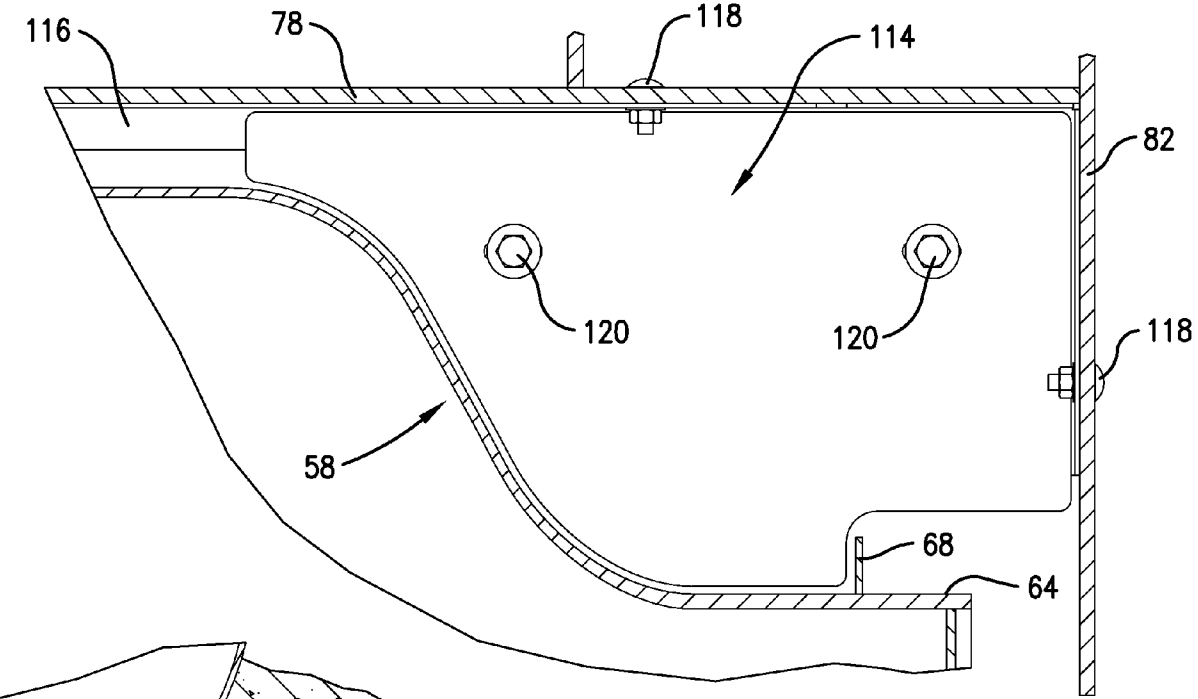
FIG. 8 is an enlarged, fragmentary, partial sectional view of a portion of the curb forming tool taken along line 8-8 of FIG. 6, depicting in detail an overflow guard spaced radially closely to the curb-forming roller.
Figure 9:
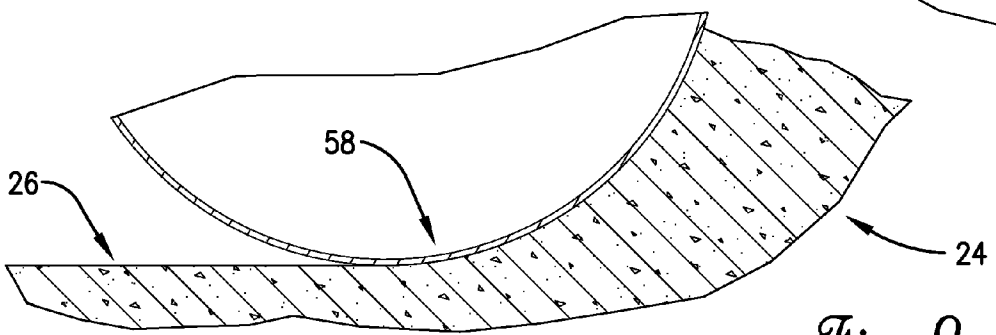
FIG. 9 is an enlarged, fragmentary, side elevational, partial sectional view of a portion of the curb forming tool taken along line 9-9 of FIG. 7, depicting in detail a portion of the curb-forming roller contacting wet concrete to shape and smooth the concrete into curved curbing.

A concrete overflow guard 114 is operably coupled with yoke element 72 to prevent wet concrete 24 from flowing over curb-forming roller 58 during operation, as will be explained in more detail below. With particular reference to FIG. 8, a laterally extending guard frame 116 is fixed to lateral frame member 78 of yoke element 72 with fasteners 118, such as bolt-and-nut assemblies. Overflow guard 114 is fixed to guard frame 116 with fasteners 120, such as bolt-and-nut assemblies, such that overflow guard 114 is closely spaced radially from curb-forming roller 58. Preferably, although not necessarily, overflow guard 114 is shaped to correspond to the shape of at least a portion of curb-forming roller 58. As depicted in FIG. 8, the shape of overflow guard 114 corresponds to the portion of curb-forming roller 58 extending from neck 64 inboard of ring 68, along shaping surface 66, and up to part of cylindrical body 62. Illustrated overflow guard 114 is formed of plastic, such that the component is easily replaced. An alternative overflow guard (not shown) that is adjustable relative to curb-forming roller 58 is clearly within the ambit of the present invention.

Structure of yoke element 72 also includes an open cylindrical sleeve 122. Sleeve 122 selectively receives a removable stand 124 that supports power tool 20 in a generally upright position when power tool 20 is not in use, as shown in FIG. 2. A stand tension adjuster 125 extends through sleeve 122 and contacts stand 124 to facilitate adjustment of stand 124, as will be readily appreciated by one of ordinary skill in the art upon review of this disclosure.

The operation of power tool 20 and a method of forming longitudinally curved concrete curbing with such power tool 20 should be apparent from the foregoing description and, therefore, will be described here only briefly. Power tool 20 is placed on longitudinally curved form 22 and positioned such that single rotary curb-forming roller 58 is disposed on top of form 22 with the outer periphery of cylindrical body 62 on top surface 46 of short form member 38, and the outer periphery of neck 64 on top surface 52 of tall form member 40.

Handle assembly 34 is used to pull and steer curb-forming roller 58 in direction of advancement 30 while maintaining ring 68 laterally adjacent inboard face 48 of tall form member 40. Hydraulic flow control valve 98 is actuated using speed control knob 99 to allow hydraulic fluid to flow through hydraulic supply lines 100, through hydraulic flow lines 96, to turn motor 36. Motor 36 rotates output shaft 104 and driving sprocket 106 to move chain 108 to turn driven sprocket 110 and shaft 70 in a direction of rotation 126. Shaft 70, rotationally fixed with respect to curb-forming roller 58, causes curb-forming roller 58 to also rotate in direction of rotation 126.

Direction of rotation 126 is such that the lower periphery of curb-forming roller 58 moves generally toward direction of advancement 30, and the upper periphery of curb-forming roller 58 moves generally opposite direction of advancement 30. Hence, as shown in FIG. 1, without the pulling and steering by operator 28, curb-forming roller 58 would tend to move in a direction opposite that of direction of advancement 30, as will be readily appreciated by one of ordinary skill in the art upon review of this disclosure. Thus, rotating curb-forming roller 58 resists the pulling force from operator 28 to shape and smooth wet concrete 24 into finished curbing 26 as operator 28 pulls and steers curb-forming roller 58 along curved form 22.

The combination of direction of rotation 126 and direction of advancement 30 causes curb-forming roller 58 to "screed" wet concrete 24 such that the concrete is compacted while the "fat" is brought up to the top to facilitate finishing of curbing 26. Particularly along neck 64 and shaping surface 66 of curb-forming roller 58, the fat can accumulate behind concrete forming device 32 and have a tendency to be carried with rotating curb-forming roller 58 in direction of rotation 126. Fat is prevented from flowing over this portion of curb-forming roller 58 by concrete overflow guard 114, which blocks the path of the fat from flowing over curb-forming roller 58, where it would otherwise fall onto finished curbing 26.

Since concrete forming device 32 consists of single curb-forming roller 58 coupled to handle assembly 34 along axis of rotation 60, power tool 20 is highly maneuverable, even by single operator 28. This enhanced maneuverability allows power tool 20 to accurately and easily follow the shape of curved form 22, including around the path of a tight curve 128, shown in FIG. 1.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and access the reasonably fair scope of the present invention as pertains to any apparatus not materially departing from but outside the literal scope of the invention set forth in the following claims.

What is claimed is:

1. A method of forming longitudinally curved concrete curbing, said method comprising the steps:

placing a single rotary curb-forming roller on a longitudinally curved form filled with wet concrete, wherein the form comprises a pair of laterally spaced, longitudinally extending, curved form members with one of the form members being shorter than the other form member, said roller including a cylindrical body, a smaller diameter neck at one end of the body, and a shaping surface extending between the body and the neck, said body and said neck being coaxial about an axis of rotation of the roller;

positioning said roller on the form in such a manner that the cylindrical body of the roller rests upon the shorter one of the form members and the smaller diameter neck of the roller rests upon the taller one of the form members;

pulling and steering said roller in a direction of advancement along the curved form, with the roller in engagement with the wet concrete as the body of the roller rides on the shorter one of the form members and the neck of the roller rides on the taller one of the form members; and driving said roller in such a direction of rotation while it is being pulled and steered along the form such that the lower periphery of the roller moves generally toward the direction of advancement to resist the pulling force and to shape and smooth the wet concrete into curbing.

2. The curb forming method as claimed in claim 1, said pulling and steering step including the step of pulling on a laterally positionable pull arm operably connected to a roller supporting yoke element.

3. The curb forming method as claimed in claim 2, said pulling and steering step further including the step of pulling on the pull arm from an operating position located outside the form.

4. The curb forming method as claimed in claim 3, said pulling and steering step further including the step of maneuvering said roller around a tight curve of the form, said tight curve having a radius of curvature of less than about five feet.

5. The curb forming method as claimed in claim 1; and preventing wet concrete from flowing over the roller onto the finished curb.

6. The curb forming method as claimed in claim 5, said preventing step including the step of blocking the flow of excess wet concrete with an overflow guard closely spaced radially from the roller on the side of the direction of pulling, said overflow guard being shaped to correspond to the shape of at least a portion of the roller.

7. The curb forming method as claimed in claim 1, said pulling and steering step including the step of maintaining alignment of the roller relative to the form by urging an alignment device laterally against one of the form members.

8. The curb forming method as claimed in claim 7, said maintaining alignment step including the step of urging a ring laterally against the inboard face of the taller one of the form members, said ring extending radially outwardly from the neck of the roller.

9. The curb forming method as claimed in claim 1, said driving step including the step of flowing hydraulic fluid through a hydraulic motor operably coupled with the roller, said hydraulic fluid passing through a flow control valve to control the flow of hydraulic fluid through the motor and the corresponding rotations speed of the roller.

10. The curb forming method as claimed in claim 1, said steps of pulling and steering the roller and driving the roller being accomplished simultaneously.

* * * * *